US006099646A

United States Patent [19]

Yang et al.

[11] Patent Number: 6,099,646

[45] Date of Patent: Aug. 8, 2000

[54] DISPENSING SYSTEM OF A COATER

[75] Inventors: Ming-Che Yang, Kaohsiung; Kuo-Feng Huang, Chu-Pei; En-Tien Tan, Hsinchu; Kuei-Hsi Lai, Hsinchu Hsien, all of Taiwan

[73] Assignee: United Microelectronics Corp., Hsinchu, Taiwan

[21] Appl. No.: 09/185,404

[22] Filed: Nov. 3, 1998

[51] Int. Cl.[7] ..... B05C 11/00

[52] U.S. Cl. ..... 118/684; 118/695; 118/696; 118/704; 118/703

[58] Field of Search ..... 118/52, 56, 319, 118/320, 684, 695, 696, 702, 703, 704, 321, 323, 712, 713

[56] References Cited

U.S. PATENT DOCUMENTS 5,134,962 8/1992 Amada et al. ..... 118/688

*Primary Examiner*—Laura Edwards
*Assistant Examiner*—George R Koch, III

[57] ABSTRACT

A dispensing system used in a spin coater is provided to transport a solvent to a wafer. The dispensing, system includes a switch valve, a sucking-back valve, a solenoid valve, a speed control unit of the sucking-back valve, and a speed control unit of the switch valve. The switch valve controls a solvent dispensing status. The sucking-back valve receives the solvent from the switch valve and exports the solvent to a wafer. The solenoid valve controls the switch valve and the sucking-back valve. The speed control unit of the switch valve is coupled between the switch valve and the solenoid valve and is used for a control of action speed on the switch valve. The speed control unit of the sucking-back valve is coupled between the switch valve and the sucking-back valve, and is used for a control of action speed of the sucking-back valve by a sufficient delay time of action.

11 Claims, 4 Drawing Sheets

DISPENSING SYSTEM OF A COATER

BACKGROUND OF THE INVENTION

1. Field of the Invention

This invention relates to an equipment used in semiconductor fabrication, and more particularly to a dispensing system for a spit-on glass (SOG) coater.

2. Description of Related Art

In fabrication processes a wafer often has a dielectric layer with uneven contours on top. If the uneven contours are not properly planarized, it may cause a difficulty to form an interconnect on it and cause a loss of pattern transferring precision. A planarization process to planarize the wafer surface is therefore greatly needed in semiconductor fabrication.

Currently, a spin-on glass (SOG) technology is widely used to locally planarize the wafer surface. The SOG technology includes a solvent containing a dissolved di-electric material. Such as silicon dioxide, and coats the wafer surface with the solvent by a spin-coating, process so as to fill concave regions on the wafer surface. A purpose of local planarization is then achieved. A complete SOG process needs two steps: coating and curing. The coating step is to distribute solvent to cover the wafer surface, and the curing step is to vaporize residual solvent by a thermal process so as to increase the SOG density and cure the structure of silicon oxide.

In the SOG process, a spin coater, such as DSN 60A, is usually used for spin-coating the wafer. FIG. 1 is a block diagram of a conventional solvent dispensing system used in a spin coater. FIG. 2 is an equipment structure of the dispensing system in FIG. 1. In FIG. 1 and FIG. 2, the solvent dispensing system includes a solenoid valve 10, a sucking-back valve 12, a switch valve 14, a pressure regulating valve 18, and several speed controllers SC1, SC2, SC3, and SC4. A solvent 16 is contained in a container 17, which can be pressurized.

A solvent flowing route is first described here. A pressure is created in the container 17 through the pressure regulating, valve 18 so as to drive the solvent 16 to the switch valve 14. When switch valve 14 is open, the solvent 16 flows through the sucking-back valve 12 ard reaches to a dispensing end 27. The solvent 16 thereby is dispensed on to a wafer 20, which is held by a spinner 22.

The switch valve 14 and suckinig-back valve 12 are further controlled by the solenoid valve 10 through the speed controllers SC1, SC2, SC3, and SC4. Air is used as an intermedium for sending control signals from the solenoid valve 10. The speed controllers SC1 and SC2 forming together as a speed control unit 13 are coupled in series between the switch valve 14 and the solenoid valve 10. The speed controllers SC3 and SC4 forming together as a speed control unit 15 are coupled in series between the sucking-back valve 12 and the solenoid valve 10. The solenoid valve 10 controls both the switch valve 14 and the sucking-back valve 12 through air, which serves as an intermedium for sending control signals from the solenoid valve 10. The solenoid valve 10 includes one air-in (AIR) end to engulf air, and one air-out (EXH) end to release air. Through the AIR end and the EXH end, the solenoid valve 10 can control the switch valve 14 and the sucking-back valve 12.

Each of speed controllers SC1, SC2, SC3, and SC4 is identical. The speed controller SC1 used as an example includes a regulating valve 26 and an one-way valve 24. The directions of the one-way valves 24 in the SC1 and the SC2 are opposite to each other.

The solenoid valve 10 can switch the dispensing system in two operation modes; a dispensing mode and a stopping mode. In the dispensing mode, the solenoid valve 10 switches the system from a stopping status to a dispensing status, and in the stopping mode, the solenoid valve 10 switches the system from a dispensing status to a stop status. Ideally, when the solenoid 10 switches to the stopping mode, the switch valve 14 is necessary to be first closed and then the sucking-back valve 19 is activated to suck the solvent 16 a little back from the dispensing end 27 in order to prevent the solvent 16 from dropping onto the wafer 20.

However, it practically is very difficult to have this time order. If the sucking-back valve 12 is activated before the switch valve 14 is closed, the suck effect is invalid. This may result in a few undesired solvent dropping onto the wafer 20 if there is any disturbance on the solvent 16 at the duct end 27. This causes a damage on the wafer 20. Similarly, when the system is switched to a dispensing mode, if the sucking-back valve 12 is firstly switched off to release the sucking force and the switch valve 14 is secondly switched on to supply the solvent 16, then again a few undesired solvent drops may drop onto the wafer 20 during the transition period. This also causes a damage on the wafer 20. A dispensing rate of the solvent 16 may also unstable.

SUMMARY OF THE INVENTION

It is therefore an objective of the present invention to provide a dispensing system used in a spin coater with an improvement of activating order control on a sucking-back valve and a switch valve so that the sucking-back valve can act later than the switch valve. This can ensure the function of the sucking-back valve can act properly in time so as to effectively prevent some undesired solvent from dropping onto a wafer. The wafer is thereby protected.

In accordance with the foregoing and other objectives of the present invention, an improved dispensing system used in a spin coater is provided to transport a solvent to a wafer. The improved dispensing system includes a switch valve, a sucking-back valve, a solenoid valve, a speed control unit of the sucking-back valve, and a speed control unit of the switch valve.

The switch valve is used to control whether the solvent is dispensed or not. The switch valve also includes a first input/output (I/O) end for a purpose of control to switch on/off. The sucking-back valve receives the solvent from the switch valve and exports the solvent to, a wafer, which is to be coated with the solvent. The sucking-back valve also includes a second I/O end for a purpose of control to either create a sucking force on the solvent or release the sucking force. The solenoid valve is used to control the dispensing system through controlling, the switch valve and the sucking-back valve. The solenoid valve includes a third I/O, an air-in end, and an air-out end, in which the air-in end and the air-out is used to engulf and release air to send control signals through air. The speed control unit of the switch valve is coupled between the first I/O end of the switch valve and the third I/O valve of the solenoid valve and is used for a control of action speed on the switch valve. The speed control unit of the sucking-back valve is coupled between the first I/O end of the switch valve and the second I/O end of the sucking-back valve, and is used for a control of action speed of the sucking-back valve by a sufficient delay time of action. During the solenoid valve switching an operation status of the dispensing system, the sucking-back valve is controlled to have a sufficient delay time of action so as to effectively achieve its purpose to protect the wafer.

BRIEF DESCRIPTION OF DRAWINGS

The invention can be more fully understood by reading the following detailed description of the preferred embodiment, with reference made to the accompanying drawings as follows.

DETAILED DESCRIPTION OF PREFERRED EMBODIMENT

An improved solvent dispensing system used in a spin coater is designed to have a sufficient delay of response time of sucking-back valve so as to improve the performance of the sucking-back valve for a protection of wafer. The purpose is achieved by making a new coupling structure between those elements used in conventional dispensing, system.

Figure 1:
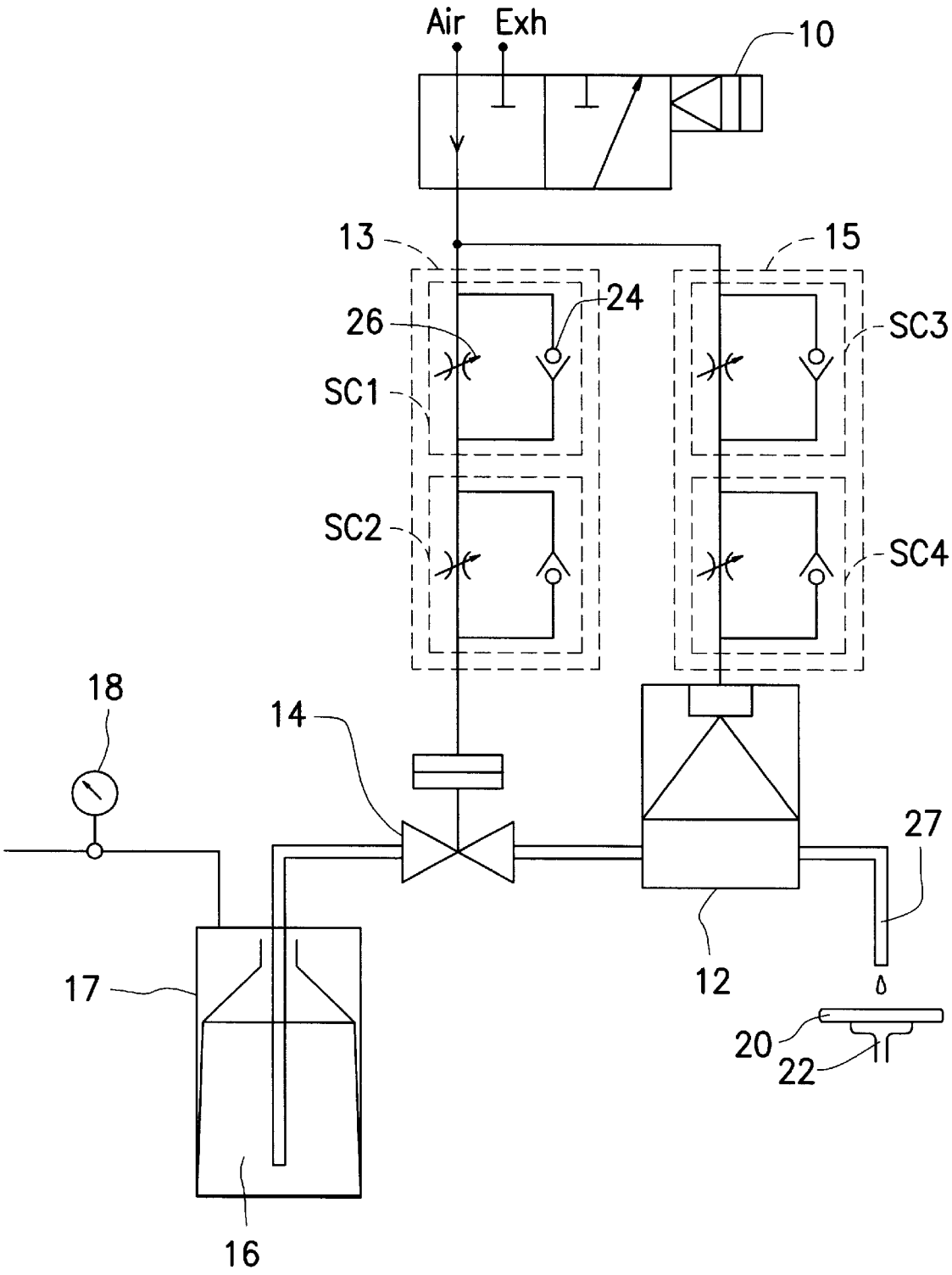
FIG. 1 (PRIOR ART)
FIG. 1 is a block diagram of a conventional solvent dispensing system used in a spin coater.
Figure 2:
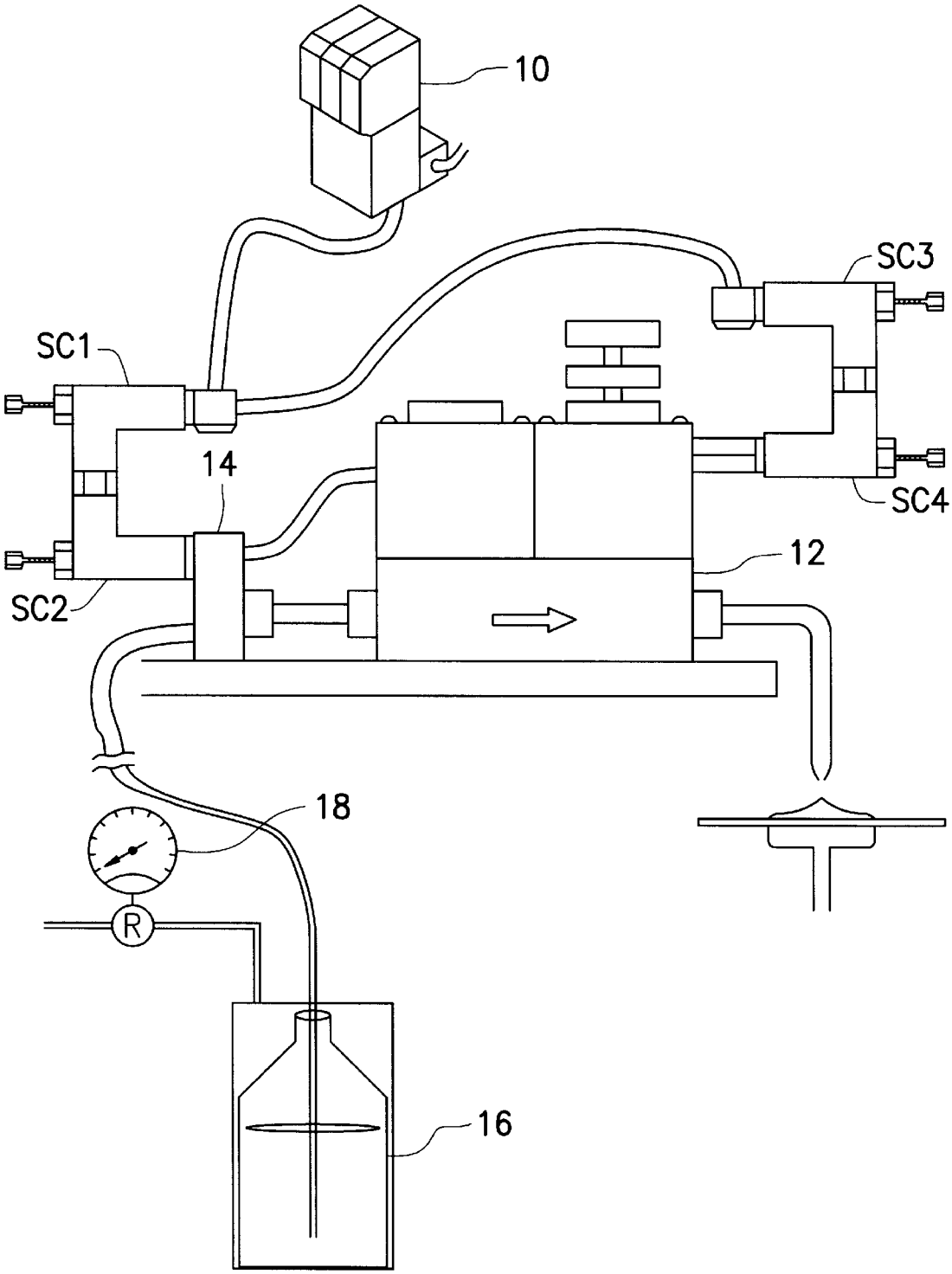
FIG. 2 (PRIOR ART)
FIG. 2 is an equipment structure of the dispensing system in FIG. 1.
Figure 3:
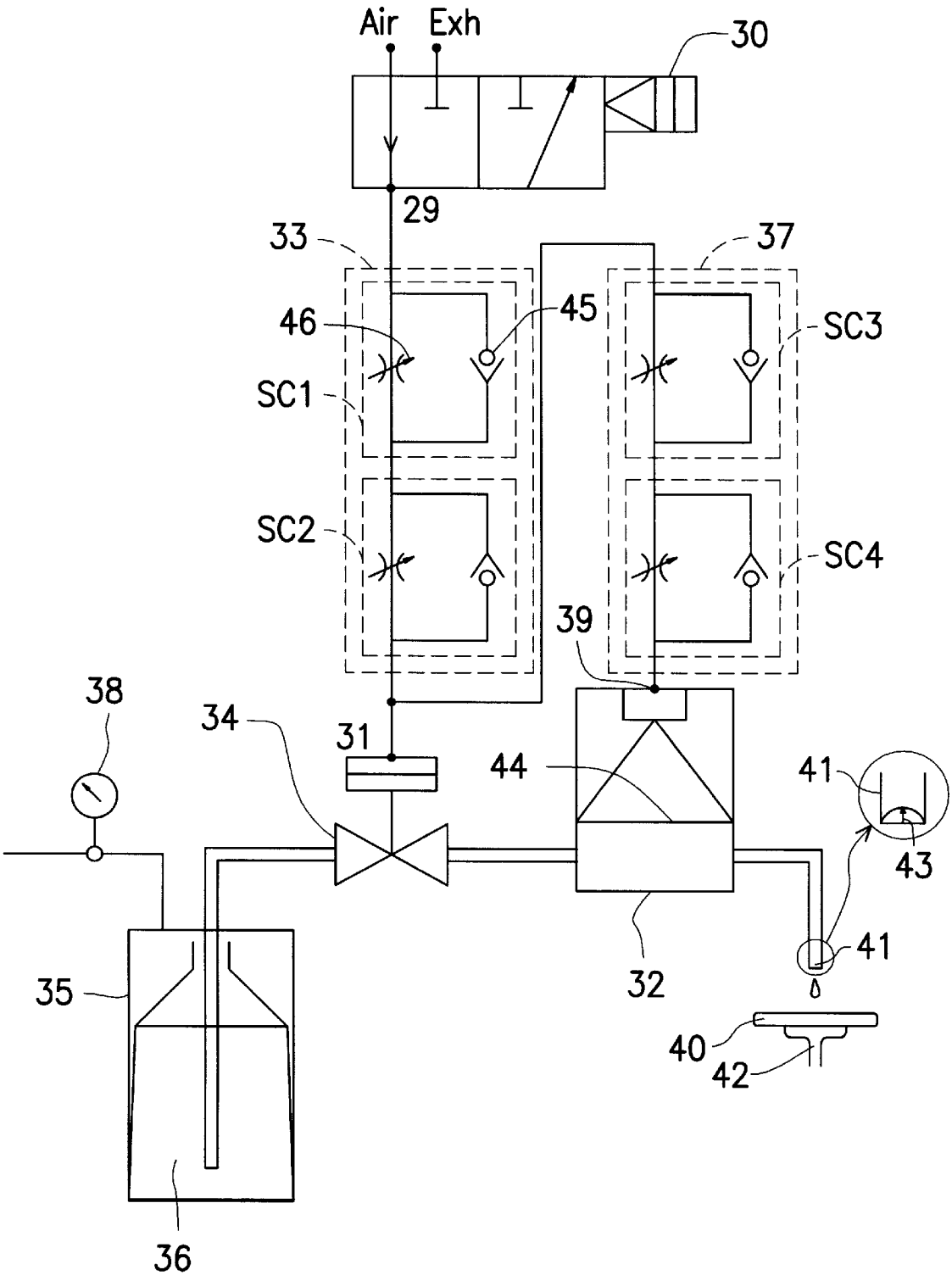
FIG. 3 is a block diagram of an improved solvent dispensing system used in a spin coater according to a preferred embodiment of the invention.
Figure 4:
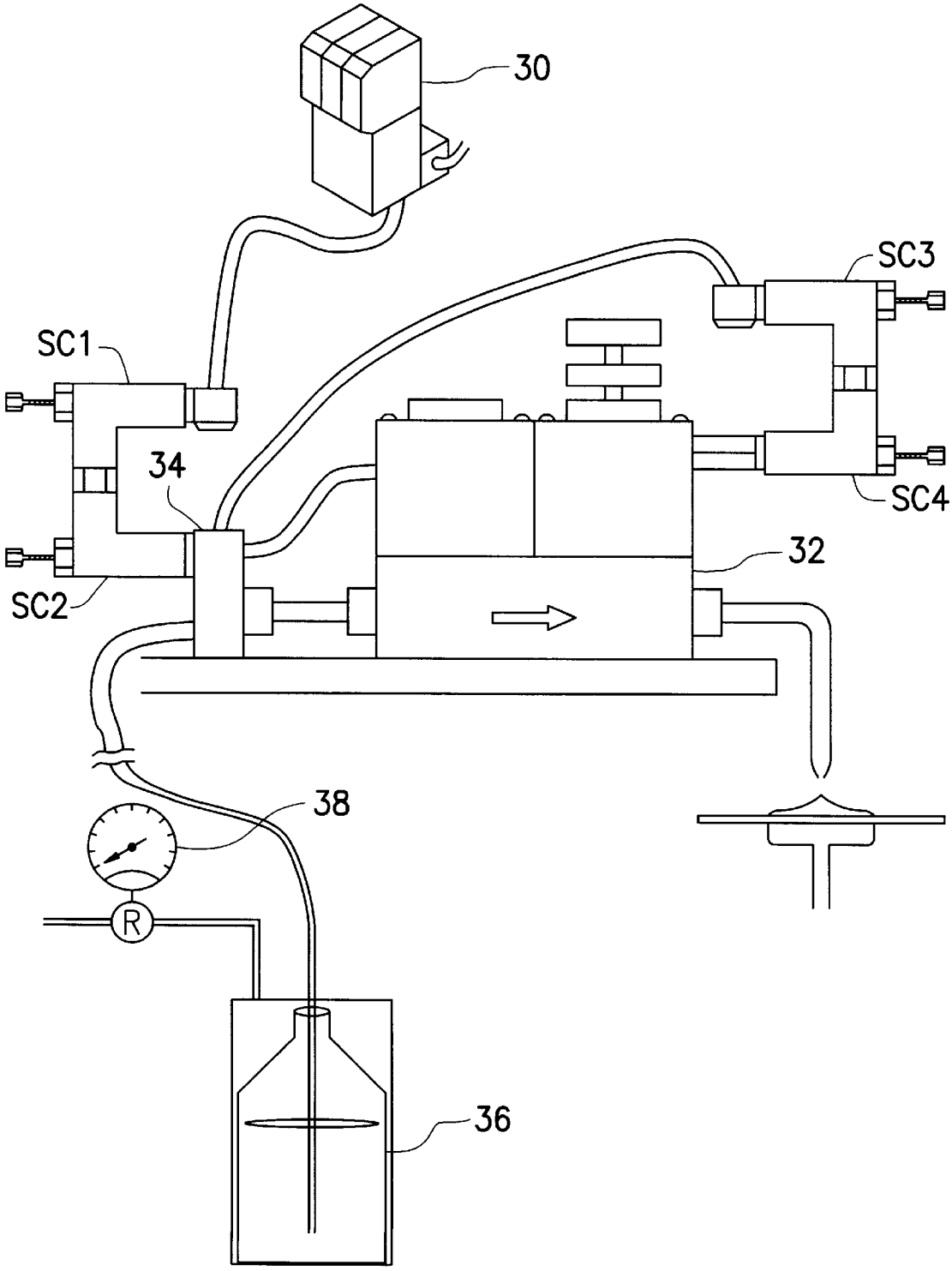
FIG. 4 is an equipment structure of the improved dispensing system in FIG. 3.

FIG. 3 is a block diagram of an improved solvent dispensing system used in a spin coater according to a preferred embodiment of the invention and FIG. 4 is an equipment structure of the improved dispensing system in FIG. 3. In FIG. 3 and FIG. 4, a spin coater, such as a spin-on glass (SOG) coater with a type of DNS 60A, is used for descriptions.

The improved solvent dispensing system includes a solenoid valve 30, a sucking-back valve 32, a switch valve 34, a pressure regulating valve 38, and several speed controllers SC1, SC2, SC3, and SC4. A solvent 36 is contained in a container 35, which can be pressurized. The speed controllers SC1 and SC2 form together as a speed control unit 33, and the speed controllers SC3 and SC4 form together as a speed control unit 37.

A solvent flowing route is described first. As the conventional one, a pressure is created in the container 35 through the pressure regulating valve 38 so as to drive the solvent 36 to the switch valve 34. When switch valve 34 is open, the solvent 36 flows through the sucking-back valve 32 and reaches to a dispensing end 41. The solvent 36 thereby is dispensed on to a wafer 40, which is held by a spinner 42. This part is conventional. The invention includes an improved control design to have proper dispensing behaviors so that the wafer 40 is effectively protected from an undesired solvent.

The control part is described in following. The switch valve 34 and sucking-back valve 32 are further controlled by the solenoid valve 30 through the speed control units 33, 37. The speed control unit 33 includes, for example, two speed controllers SC1 and SC2 coupled in cascade, and the speed control unit 37 includes, for example, two speed controllers SC3 and SC4 coupled in cascade. The number of the speed controllers used can vary according to the actual requirement. Air is used as an intermedium for sending control signals from the solenoid valve 30 to the switch valve 34 and the sucking-back valve 32. The speed control unit 33 are coupled between a first input/output end 31 of the switch valve 34 and a third I/O end 29 of the solenoid valve 30, and the speed control unit 37 are coupled between the first input/output end 31 of the switch valve 34 and a second I/O end 39 of sucking-back valve 32. In this coupling manner, the solenoid valve 30 controls both the switch valve 34 and the sucking-back valve 32 through air, which serves as an intermedium for sending control signals from the solenoid valve 30. The solenoid valve 20 includes one air-in (AIR) end to engulf air, and one air-out (EXH) end to release air. Through the AIR end and the EXH end, the solenoid valve 30 produce control signals to control the switch valve 34 and the sucking-back valve 32. The speed of the control signals is thereby controlled by the speed control units 33, 37.

Each of speed controllers SC1, SC2, SC3, and SC4 is identical. The speed controller SC1 used as an example includes a regulating valve 46 and an one-way valve 45. For the speed control unit 33, the directions of the one-way valves 45 in the SC1 and the SC2 are opposite to each other. Similarly, the directions of the one-way valves 45 in the SC3 and the SC4 are opposite to each other. The path between the solenoid valve 30 and the switch valve 34 includes the speed control unit 33, which is commonly used. The path between the solenoid valve 30 and the sucking-back valve 32 includes not only the speed control unit 33 but also the speed control unit 37. The speed control unit 37 relatively delays a sufficient delay time of control signals to the sucking-back valve 32 so that the sucking-back valve 32 responds later than the switch valve 34. This is the main characteristics of the invention. This manner a lows the suckinig,-back valve 32 to create or release a sucking force on the solvent 36 from a duct end 41. The effect of the sucking force can be seen from an enlarged drawing beside the duct end 41. The sucking-back valve 32 includes a diaphragm 44 to create or release a sucking force. For example, the sucking force is respectively created or released by pulling inwardly or pushing outwardly the diaphragm 44. When solve 36 is not dispensed, the sucking force can pull the solvent 36 back and form a concave surface 43 understood as a natural effect. The sucking force is small but just sufficiently to hold the solvent 36 without dropping.

As mentioned in previous part about the conventional behaviors, during a transition time between the stopping mode and the dispensing mode, if the sucking-back valve does not respond with a sufficient delay time, a few solvent drops can undesired drop onto the wafer. In the invention, since the speed control unit 37 serves as a delayer in sending control signals, the sucking-back valve 32 can respond with proper delay to achieve the purpose of protection on the wafer 40. For example, when the solenoid valve 30 switches the improved system from a dispensing mode to a stopping mode, the switch valve 34 stops before the sucking-back valve 32 creates a sucking force with a delay time so that the sucking force effectively hold the solvent 36. If the time order is reversed, the sucking force becomes invalid, some undesired solvent 36 may drop onto the wafer 40 when a disturbance, such as a shake, occurs. Similarly, when the solenoid valve 30 switches the improved system from a stopping mode to a dispensing mode, the switch valve 34 is ensure to be switched on before the sucking-back valve 32 is inactivated to release the sucking force with a delay time contributed by the speed control unit 37. If the time order is reversed, some undesired solvent 36 may drop onto the wafer 40 before the dispensing actually starts with a control of dispensing rate. In the manner of the invention, the solvent 36 always maintained without dropping a little.

In conclusion, the invention use the speed control unit 37 to providing a delay time of control signals to the sucking-back valve 32 so that the solvent 36 is always held at the duct end 41 without dropping.

The invention has been described using an exemplary preferred embodiment. However, it is to be understood that the scope of the invention is not limited to the disclosed embodiment. On the contrary, it is intended to cover various modifications and similar arrangements. The scope of the claims, therefore, should he accorded the broadest interpretation so as to encompass all such modifications and similar arrangements.

What is claimed is:

1. A dispensing system used in a coater to dispense a solvent to a wafer, the dispensing system comprising:

a switch valve, which is used to determine whether the solvent is dispensed or note, wherein the switch valve comprises a first input/output I/O end for a control signal;

a sucking-back valve, which is used to receive the solvent from the switch valve and export the solvent to the wafer, wherein the sucking-valve comprises a second I/O end for the control signal and is controlled to create or release a sucking force on the solvent;

a solenoid valve, which is used to produce the control signal to control the switch valve and the sucking-back valve in order to switch the system between a dispensing mode and a stopping mode, wherein the solenoid valve comprises a third I/O end;

a first speed control unit, which is coupled between the first I/O end of the switch valve and the third I/O end of the solenoid valve in order to control a response speed of the switch valve;

a second speed control unit, which is coupled between the first I/O end of the switch valve and the second I/O end of the sucking-back valve in order to control a response speed of sucking-back valve, wherein when the solenoid valve switches between the dispensing mode and the stopping mode, the control signal produced by the solenoid valve is sent to the switch valve through the first speed control unit, and to the sucking-back valve through the first speed control unit and the second speed control unit so that the response speed of the sucking-back valve is sufficiently later than the switch valve.

2. The dispensing system of claim 1, wherein the solvent comprises spine-on glass (SOG).

3. The dispensing system of claim 1, wherein the first speed control unit comprises two first speed controllers coupled in cascade.

4. The dispensing system of claim 3, wherein each of the two first speed controllers comprises an one-way valve and a regulating valve, coupled in parallel, and the one-way valves of the two first speed controllers are opposite to each other.

5. The dispensing system of claim 1, wherein the second speed control unit comprises two second speed controllers coupled in cascade.

6. The dispensings system of claim 5, wherein each of the two second speed controllers comprises an one-way valve and a regulating valve, coupled in parallel, and the one-way valves of the two second speed controllers are opposite to each other.

7. The dispensing system of claim 1, wherein the control signal is produced by the solenoid and sent from the third I/O end to the first I/O end and the second I/O end through an air serving as an intermedium.

8. The dispensing system of claim 1, wherein the solenoid valve switch the system from a stopping status to a dispensing status in the dispensing mode, and the solenoid valve switch the system from a dispensing status to a stopping status in the stopping mode.

9. The dispensing system of claim 8, wherein in the stopping mode, the switch valve is switched off and then the sucking-back valve creates the sucking force on the solvent.

10. The dispensing system of claim 8, wherein in the dispensing mode, the switch valve is switched on and then the sucking-back valve releases the sucking force on the solvent.

11. The dispensing system of claim 1, wherein the sucking-back valve further comprises a diaphragm, which can be controlled to move inwardly or outwardly so as to produce or release a sucking force on the solvent.

* * * * *